US007836619B2

(12) United States Patent
Coutts

(10) Patent No.: US 7,836,619 B2
(45) Date of Patent: Nov. 23, 2010

(54) INFLATABLE FLAG DISPLAY

(76) Inventor: Stephen Coutts, 1315 Franklin St., Apt. C, Santa Monica, CA (US) 90404

( * ) Notice: Subject to any disclaimer, the term of this patent is extended or adjusted under 35 U.S.C. 154(b) by 0 days.

(21) Appl. No.: 12/268,995

(22) Filed: Nov. 11, 2008

(65) Prior Publication Data

US 2010/0115808 A1 May 13, 2010

(51) Int. Cl.
*G09F 17/00* (2006.01)

(52) U.S. Cl. ..... 40/218; 40/610; 40/412; 40/439

(58) Field of Classification Search ..... 40/218, 40/610, 412, 439; 446/226, 220; 116/173
See application file for complete search history.

(56) References Cited

U.S. PATENT DOCUMENTS

| | | | | | |
|---|---|---|---|---|---|
| 1,642,022 | A | | 9/1927 | Groh | |
| 2,348,250 | A | * | 5/1944 | Gardner et al. | 40/411 |
| 3,149,352 | A | * | 9/1964 | Christiansen | 441/11 |
| 3,197,628 | A | * | 7/1965 | Schuff | 362/157 |
| 3,358,398 | A | * | 12/1967 | Chalfin | 40/596 |
| 5,467,543 | A | * | 11/1995 | Fink et al. | 40/538 |
| 5,692,328 | A | | 12/1997 | Pettit | |
| 6,162,106 | A | * | 12/2000 | Shieh | 441/30 |
| 6,186,857 | B1 | * | 2/2001 | Gazit et al. | 446/226 |
| 6,804,905 | B1 | * | 10/2004 | Burger et al. | 40/610 |
| D530,756 | S | | 10/2006 | Greenwald | |
| 7,322,137 | B2 | * | 1/2008 | Machala | 40/439 |
| 2002/0178997 | A1 | | 12/2002 | Tsui-Hua | |

* cited by examiner

*Primary Examiner*—Cassandra Davis
(74) *Attorney, Agent, or Firm*—David A. Belasco; Belasco Jacobs & Townsley, LLP

(57) ABSTRACT

An inflatable flag display includes a shaft having a hollow core and a sealed upper end. An aperture is located in the upper portion of the shaft and penetrates from an outer surface to the hollow core. A supporting base is connected to the shaft. A gas input connection is affixed to the shaft or the base and is in fluid communication with the core. An inflatable flag member is affixed to the shaft, formed of flexible material and has at least one inflatable chamber. The chamber is in fluid communication with the aperture and has an exhaust vent. A compressed gas source is in fluid communication with the gas input connection. A compressed gas modulator controls pressure or duration of gas flow, causing the flag to undulate. A variant includes means for rotating the shaft as the flag is inflated. Another variant includes an inflatable column replacing the shaft.

12 Claims, 7 Drawing Sheets

INFLATABLE FLAG DISPLAY

FIELD OF INVENTION

This invention relates to the field of visual display items, and more specifically to an inflatable flag display that will simulate the motion of a waving flag.

BACKGROUND OF THE INVENTION

Through the ages flags have been used as attention-getting devices, advertising everything from national sovereignty to discounts on oil changes. While providing some visual information when simply suspended from a flag pole, flags are much more effective when waved manually or when tossed by the wind. As a blowing breeze is notoriously unreliable, people have often resorted to physically moving a flag pole to cause the flag to wave and thus more particularly demonstrate its message. Flag waving for extended periods soon becomes an arduous effort and paying people to wave a flag for you can become expensive. As a result, various systems have been developed to provide a waving flag image that do not require human muscle power.

U.S. Pat. No. 3,149,352, issued to Christiansen, is directed to a diver's flag made up of an inflated vertical standard or pole with an attached inflatable flag-type portion. The flag is made of plies of flexible plastic material which are sealed in order to form a closed space for air. A valve is attached to the plastic material and communicates with the internal air space in order to allow for inflation of the device. The plies are configured in order to provide a vertical post or buoy portion and a flag portion which extends at right angles from the top of the post or buoy. The flag portion includes an air column which is in communication with the interior of post so that column may be inflated causing the flag to extend directly outwardly of the posts and ensure its visibility.

U.S. Pat. No. 6,162,106, issued to Shich is directed to an inflatable flag buoy workable in both the daytime and at night. The buoy includes an integral inflatable air chamber generally divided into a seat portion, a pole portion, and a flag portion. The flag portion extends outwardly from the pole portion to complete the flag structure.

U.S. Pat. No. 1,642,022, issued to Groh is directed to a sign that utilizes inflatable hollow tubes to form individual alpha numeric figures in order to provide a sign that is lighter in weight than the weight of the air it displaces. The sign has the characteristics of a flag and may be attached to a vertical member such as a flag pole.

U.S. Pat. No. 5,692,328, issued to Pettit disclose a flag waving apparatus in which the vertical pole portion, attached to a drive arrangement with a motor that provides a rotational oscillation to the flag.

U.S. Patent Application No. 2002/0178997, published for Tsui-Hua is directed to the structure of a flag elevating/descending device. The device includes a rotating tube which rotates about elevating/descending tube which allows the flag to rotate when the wind blows without having the flag wind around the flag pole.

U.S. Pat. No. 3,995,580 issued to Serrone, is directed to a flag waving device wherein the waving condition of rotation of the flag about the vertical standard is produced by mechanical means rather than by the effects of air currents.

U.S. Pat. No. D530,756, issued to Greenwald, is directed to a novelty noise maker incorporating an inflated stick and flag. This Design Patent is a flag device has both an inflatable staff and pennant.

It is an objective of the present invention to provide a flag waving device that does not require human muscle power input in the absence of wind. It is a further objective to provide such a device that will garner substantial notice for its message through rapid and irregular movements that are representative of a wind-tossed flag. It is a still further objective of the invention to provide a device that can vary the rate and characteristics of the flag waving. It is yet a further objective to provide a device that is simple to operate and inexpensive to produce. Finally, it is an objective of the present invention to provide such a device that is durable attractive and long-lasting.

While some of the objectives of the present invention are disclosed in the prior art, none of the inventions found include all of the requirements identified.

SUMMARY OF THE INVENTION (1) The present invention addresses all of the deficiencies of prior art inflatable flag displays and satisfies all of the objectives described above.

An inflatable flag display providing the desired features may be constructed from the following components. A shaft is provided. The shaft has a hollow core, a sealed upper end, an upper portion, a lower end and a lower portion. At least one aperture is provided. The aperture is located in the upper portion and penetrates from an outer surface of the shaft to the hollow core. A supporting base is provided. The base is connected to the lower end. A gas input connection is provided. The connection is affixed to the shaft or the base and is in fluid communication with the hollow core. At least one inflatable flag member is provided. The flag member is affixed to the shaft, formed of flexible material and has at least one inflatable chamber. The chamber is in fluid communication with the at least one aperture and has at least one exhaust vent. A compressed gas source is provided. The gas source is in fluid communication with the gas input connection. When compressed gas is distributed from the compressed gas source to the gas input connection, the inflatable chamber will become filled with compressed gas and cause the inflatable flag member to assume an erect posture with the compressed gas dissipating through the at least one exhaust vent.

(2) In a variant of the invention, a first compressed gas modulating device is provided. The first modulating device is in fluid communication with and located between the compressed gas source and the gas input connection. The first modulating device permits compressed gas to flow intermittently into the gas input connection for a first predetermined period of time, after which the flow is terminated for a second predetermined period of time, and then resumed.

(3) In another variant, at least one of the first and second predetermined periods of time may be varied by a user.

(4) In still another variant, a second compressed gas modulating device is provided. The second modulating device is in fluid communication with and located between the compressed gas source and the gas input connection. The second modulating device permits compressed gas to flow intermittently into the gas input connection until a first predetermined pressure in the flag member has been reached, after which the flow is terminated until a second, lower predetermined pressure has been reached. The flow is then resumed.

(5) In yet another variant, at least one of the first and second predetermined pressures may be varied by a user.

(6) In a further variant, the shaft rotates about the supporting base.

(7) In still a further variant, the compressed gas causes the shaft to rotate about the supporting base.

(8) In yet a further variant, an inflatable flag display, includes an inflatable column. The column has a hollow core, a sealed upper end, an upper portion, a lower end and a lower portion. At least one aperture is provided. The aperture is located in the upper portion and penetrates from an outer surface of the column to the hollow core. A gas input connection is provided. The connection is affixed to the column and is in fluid communication with the hollow core. At least one inflatable flag member is provided. The flag member is affixed to the inflatable column, formed of flexible material and has at least one inflatable chamber. The chamber is in fluid communication with the at least one aperture and has at least one exhaust vent. A compressed gas source is provided. The gas source is in fluid communication with the gas input connection. When compressed gas is distributed from the compressed gas source to the gas input connection, the inflatable chamber will become filled with compressed gas and cause the inflatable flag member to assume an erect posture with the compressed gas dissipating through the at least one exhaust vent.

(9) In another variant of the invention, a first compressed gas modulating device is provided. The first modulating device is in fluid communication with and located between the compressed gas source and the gas input connection. The first modulating device permits compressed gas to flow intermittently into the gas input connection for a first predetermined period of time, after which the flow is terminated for a second predetermined period of time, and then resumed.

(10) In still another variant, at least one of the first and second predetermined periods of time may be varied by a user.

(11) In yet another variant, a second compressed gas modulating device is provided. The second modulating device is in fluid communication with and located between the compressed gas source and the gas input connection. The second modulating device permits compressed gas to flow intermittently into the gas input connection until a first predetermined pressure in the flag member has been reached, after which the flow is terminated until a second, lower predetermined pressure has been reached. The flow is then resumed.

(12) In a final variant, at least one of the first and second predetermined pressures may be varied by a user.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-8 illustrate an inflatable flag display 10 providing the desired features may be constructed from the following components. As illustrated in FIGS. 1, 2, 5 and 8, a shaft 14 is provided. The shaft 14 has a hollow core 18, a sealed upper end 22, an upper portion 26, a lower end 30 and a lower portion 34. At least one aperture 38 is provided. The aperture 38 is located in the upper portion 26 and penetrates from an outer surface 42 of the shaft 14 to the hollow core 18. A supporting base 46 is provided. The base 46 is connected to the lower end 30. A gas input connection 50 is provided. The connection 50 is affixed to the shaft 14 or the base 46 and is in fluid communication with the hollow core 18. At least one inflatable flag member 54 is provided. The flag member 54 is affixed to the shaft 14, formed of flexible material and has at least one inflatable chamber 58. The chamber 58 is in fluid communication with the at least one aperture 38 and has at least one exhaust vent 62. A compressed gas source 66 is provided. The gas source 66 is in fluid communication with the gas input connection 50. When compressed gas 70 is distributed from the compressed gas source 66 to the gas input connection 50, the inflatable chamber 58 will become filled with compressed gas 70 and cause the inflatable flag member 54 to assume an erect posture with the compressed gas 70 dissipating through the at least one exhaust vent 62.

Figure 1:
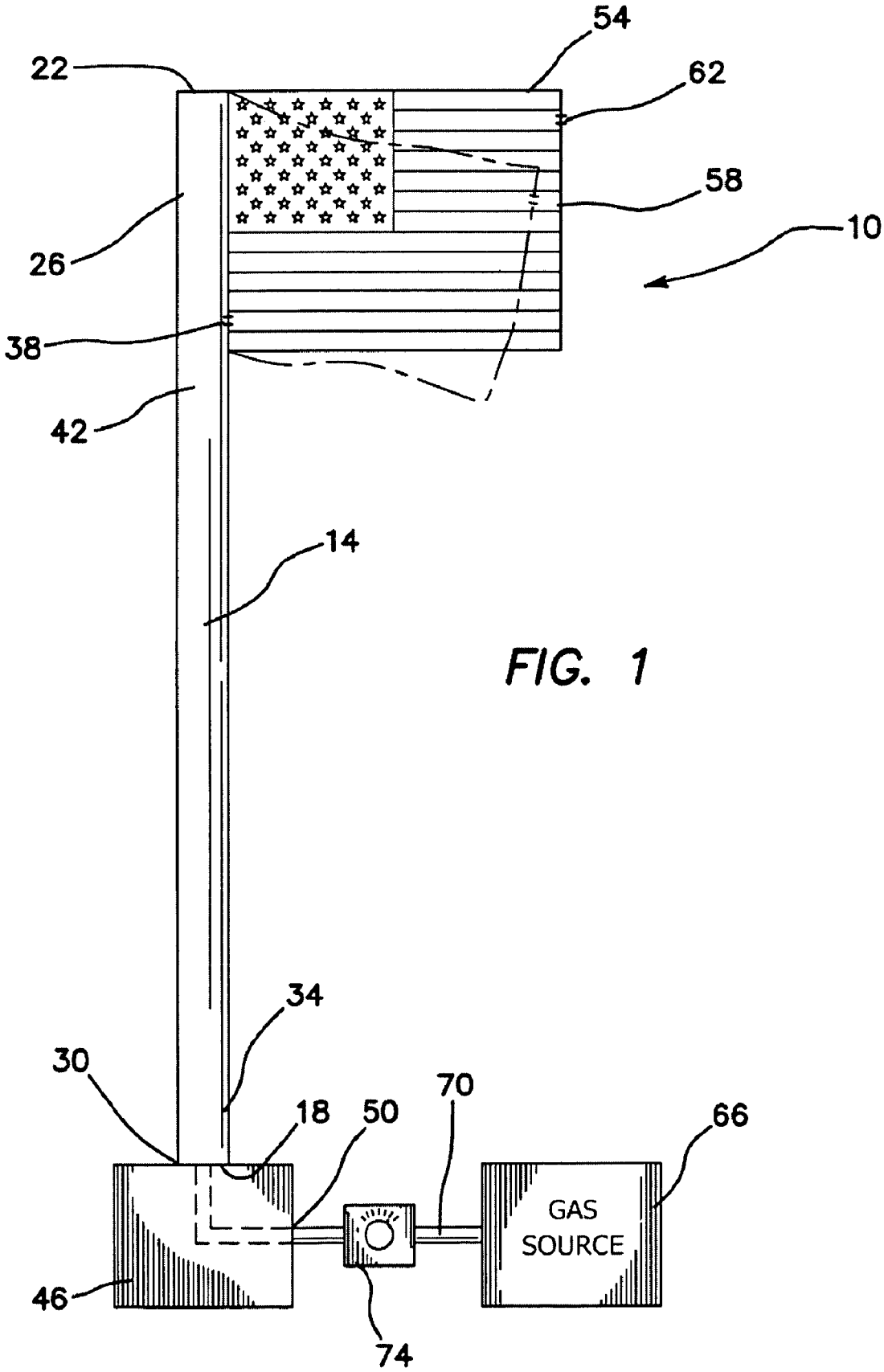
FIG. 1 is a side elevational view of a first embodiment of the invention illustrating a first compressed gas modulating device that varies the inflation interval.

(2) In a variant of the invention, as illustrated in FIG. 1, a first compressed gas modulating device 74 is provided. The first modulating device 74 is in fluid communication with and located between the compressed gas source 66 and the gas input connection 50. The first modulating device 74 permits compressed gas 70 to flow intermittently into the gas input connection 50 for a first predetermined period of time, after which the flow is terminated for a second predetermined period of time, and then resumed.

(3) In another variant, at least one of the first and second predetermined periods of time may be varied by a user.

Figure 2:
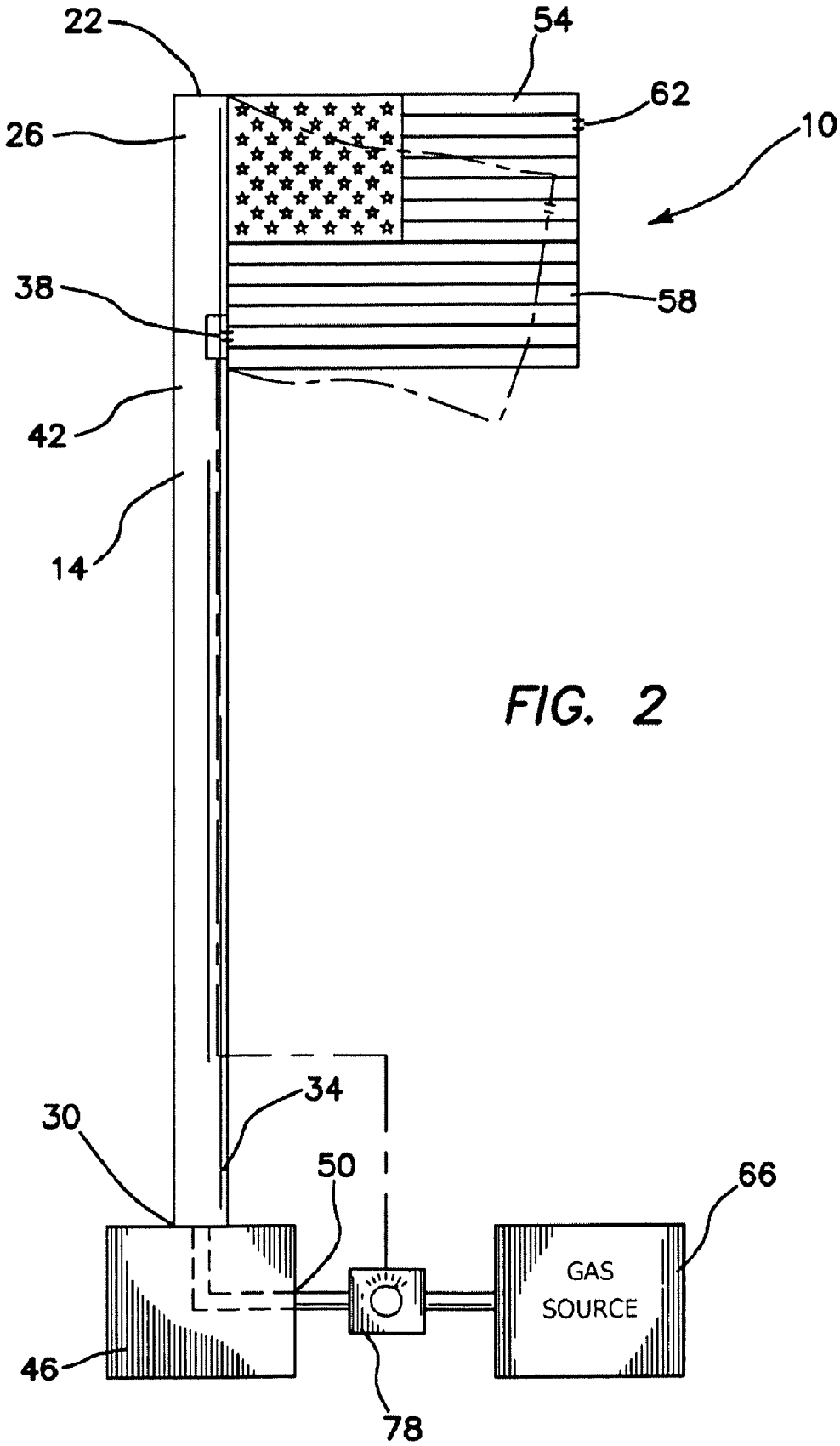
FIG. 2 is a side elevational view of the FIG. 1 embodiment illustrating a second compressed gas modulating device that varies pressure in the display.

(4) In still another variant, as illustrated in FIG. 2, a second compressed gas modulating device 78 is provided. The second modulating device 78 is in fluid communication with and located between the compressed gas source 66 and the gas input connection 50. The second modulating device 78 permits compressed gas 70 to flow intermittently into the gas input connection 50 until a first predetermined pressure (not illustrated) in the flag member 54 has been reached, after which the flow is terminated until a second, lower predetermined pressure ( not illustrated) has been reached. The flow is then resumed.

(5) In yet another variant, at least one of the first and second predetermined pressures may be varied by a user.

Figure 3:
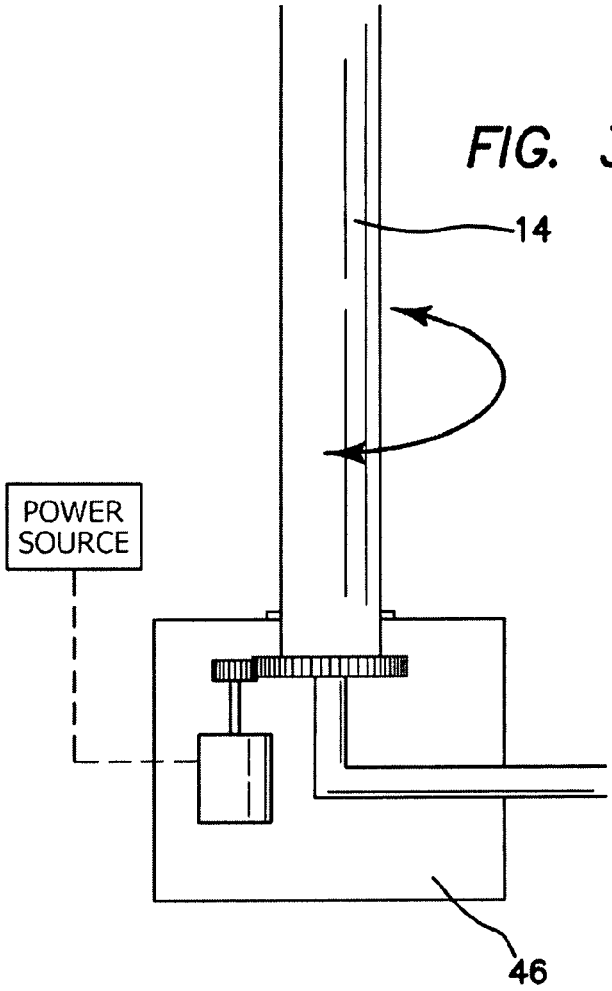
FIG. 3 is a side elevational view of a rotating base for the FIG. 1 embodiment that is driven by an electric motor.
Figure 4:
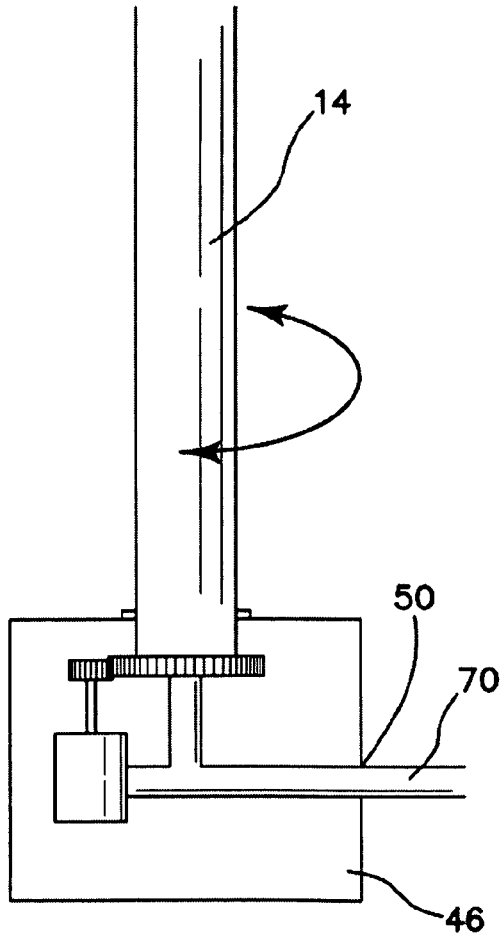
FIG. 4 is a side elevational view of a rotating base for the FIG. 1 embodiment that is driven gas pressure.
Figure 5:
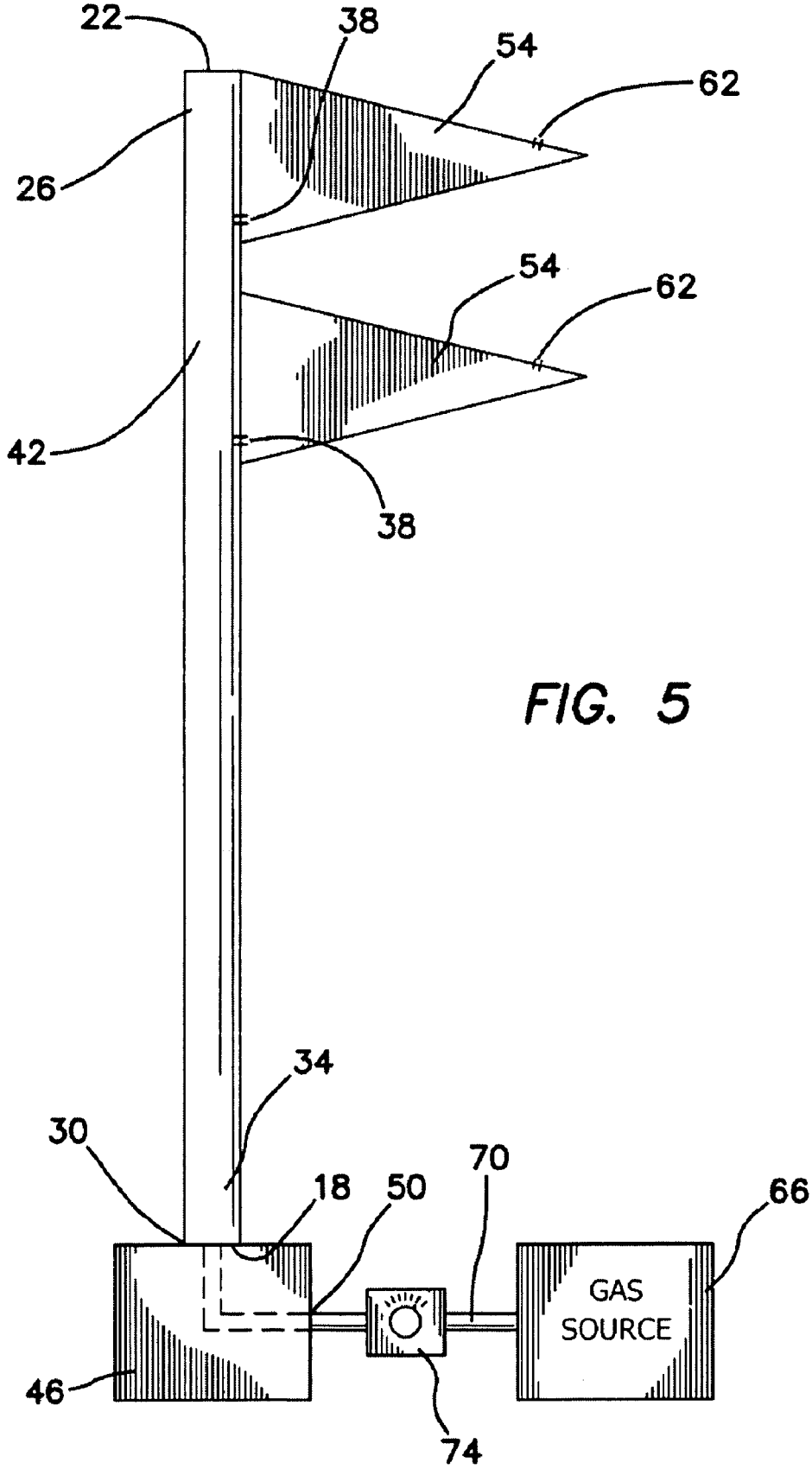
FIG. 5 is a side elevational view of the FIG. 1 embodiment illustrating multiple flag members.

(6) In a further variant, as illustrated in FIGS. 3 and 4, the shaft 14 rotates about the supporting base 46.

(7) In still a further variant, as illustrated in FIG. 4, the compressed gas 70 causes the shaft 14 to rotate about the supporting base 46.

Figure 6:
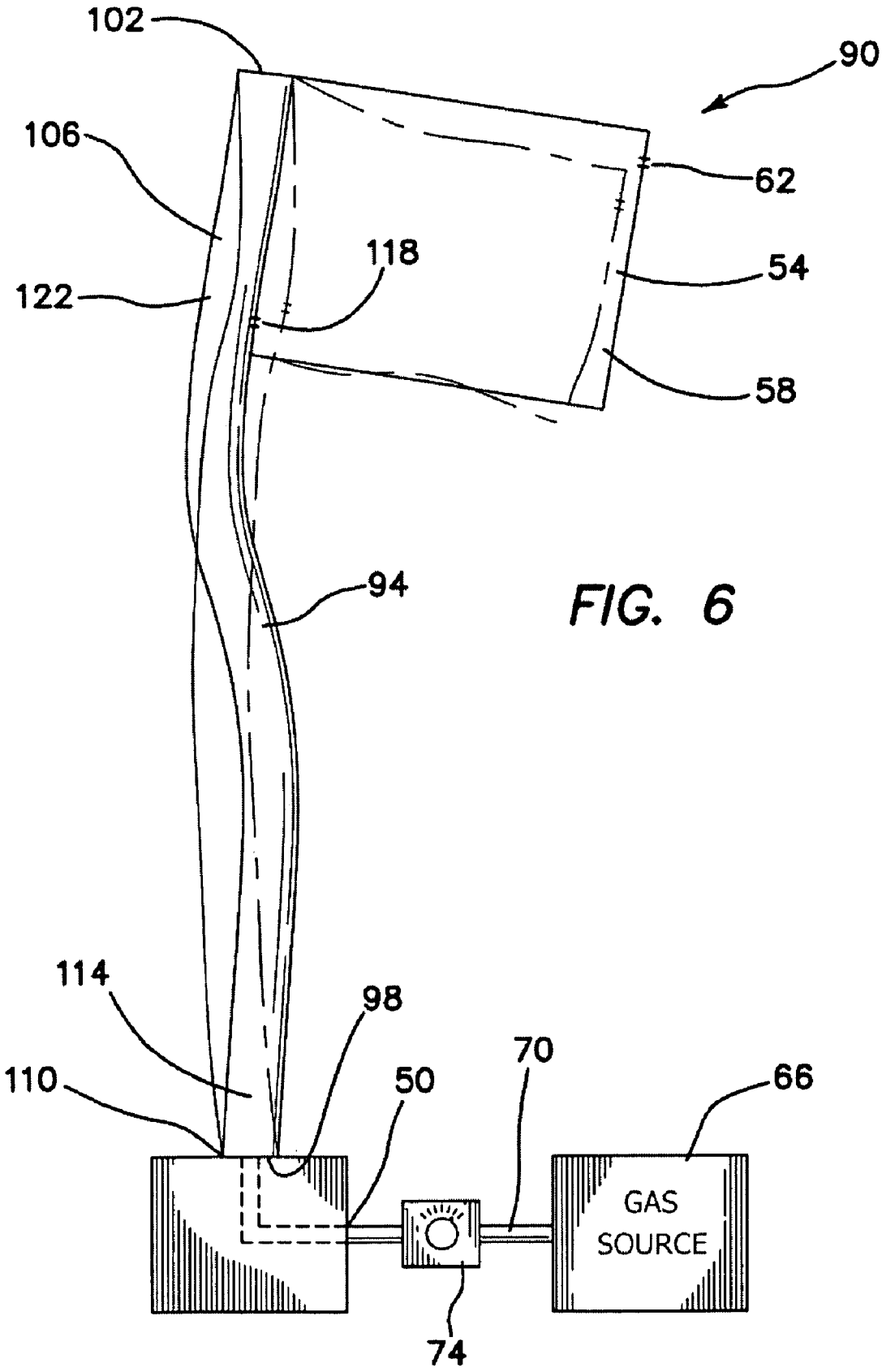
FIG. 6 is a side elevational view of a second embodiment of the invention illustrating an inflatable column supporting the flag member and a first compressed gas modulating device that varies the inflation interval.
Figure 7:
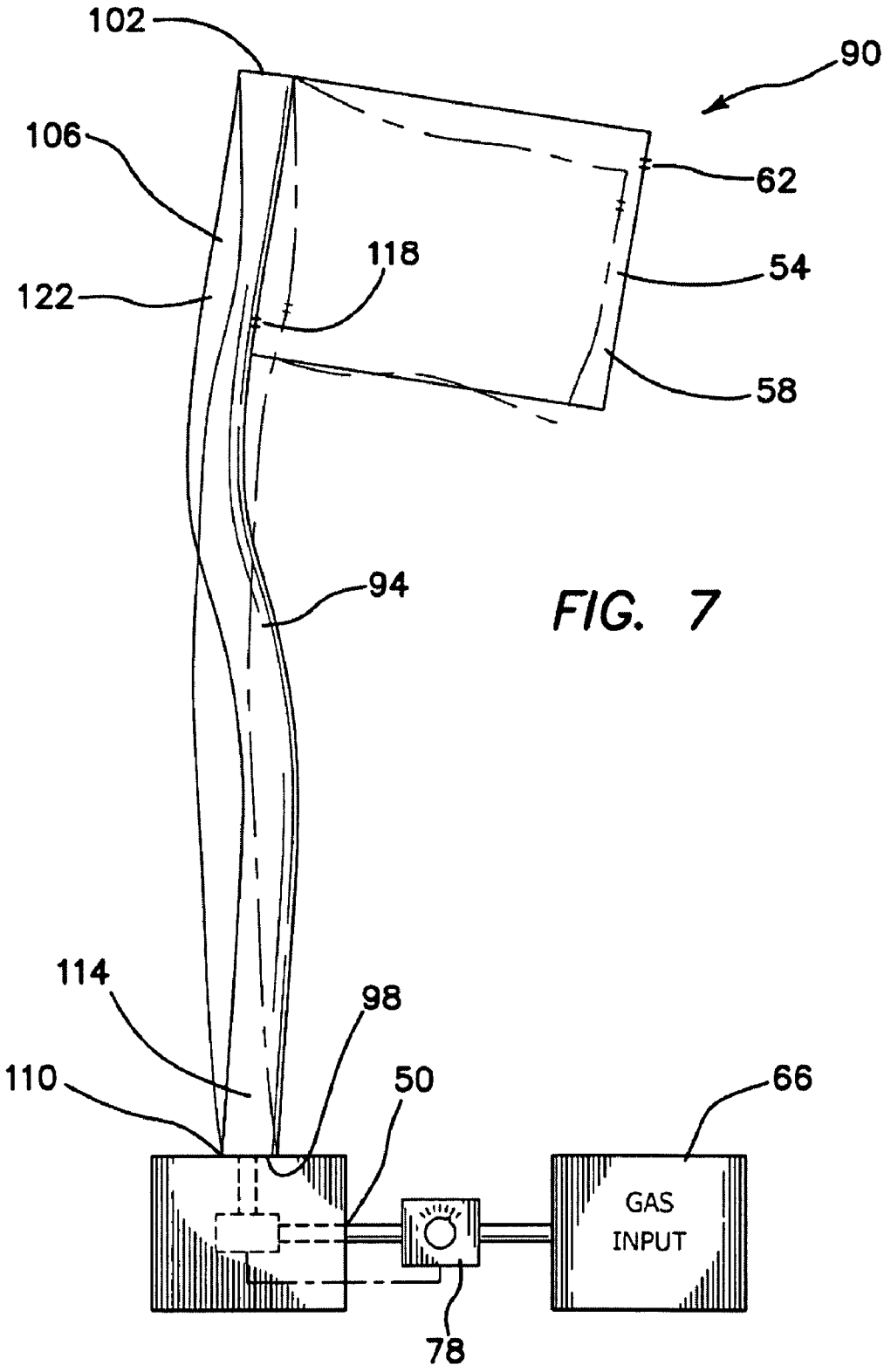
FIG. 7 is a side elevational view of the FIG. 6 embodiment of the invention illustrating an inflatable column supporting the flag member and a second compressed gas modulating device that varies pressure in the display.
Figure 8:
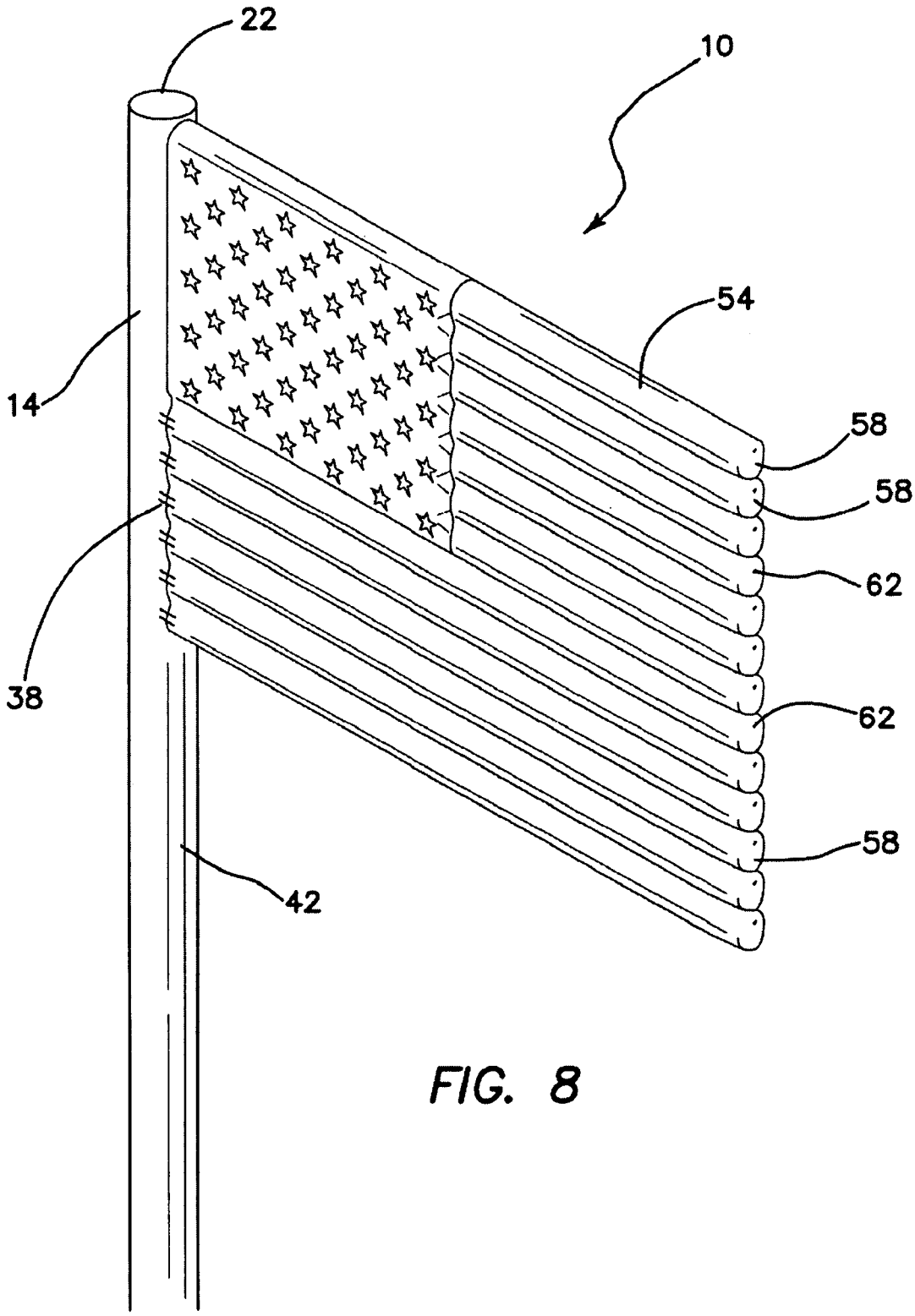
FIG. 8 is a perspective view of the FIG. 1 embodiment illustrating a flag member with multiple inflatable chambers.

(8) In yet a further variant, as illustrated in FIGS. 6 and 7, an inflatable flag display 90 includes an inflatable column 94. The column 94 has a hollow core 98, a sealed upper end 102, an upper portion 106, a lower end 110 and a lower portion 114. At least one aperture 118 is provided. The aperture 118 is located in the upper portion 106 and penetrates from an outer surface 122 of the column 94 to the hollow core 98. A gas input connection 50 is provided. The connection 50 is affixed to the column 94 and is in fluid communication with the hollow core 98. At least one inflatable flag member 54 is provided. The flag member 54 is affixed to the inflatable column 94, formed of flexible material and has at least one inflatable chamber 58. The chamber 58 is in fluid communication with the at least one aperture 118 and has at least one exhaust vent 62. A compressed gas source 66 is provided. The gas source 66 is in fluid communication with the gas input connection 50. When compressed gas 70 is distributed from the compressed gas source 66 to the gas input connection 50, the inflatable chamber 58 will become filled with compressed gas 70 and cause the inflatable flag member 54 to assume an erect posture with the compressed gas 70 dissipating through the at least one exhaust vent 62.

(9) In another variant of the invention, as illustrated in FIG. 6, a first compressed gas modulating device 74 is provided. The first modulating device 74 is in fluid communication with and located between the compressed gas source 66 and the gas input connection 50. The first modulating device 74 permits compressed gas 70 to flow intermittently into the gas input connection 50 for a first predetermined period of time, after which the flow is terminated for a second predetermined period of time, and then resumed.

(10) In still another variant, at least one of the first and second predetermined periods of time may be varied by a user.

(11) In yet another variant, as illustrated in FIG. 7, a second compressed gas modulating device 78 is provided. The second modulating device 78 is in fluid communication with and located between the compressed gas source 66 and the gas input connection 50. The second modulating device 78 permits compressed gas 70 to flow intermittently into the gas input connection 50 until a first predetermined pressure (not illustrated) in the flag member 54 has been reached, after which the flow is terminated until a second, lower predetermined pressure (not illustrated) has been reached. The flow is then resumed.

(12) In a final variant, at least one of the first and second predetermined pressures may be varied by a user.

The inflatable flag displays 10 and 90 have been described with reference to particular embodiments. Other modifications and enhancements can be made without departing from the spirit and scope of the claims that follow.

The invention claimed is:

1. An inflatable flag display, comprising:

a shaft, said shaft having a hollow core, a sealed upper end, an upper portion, a lower end and a lower portion;

at least one aperture, said aperture disposed in said upper portion and penetrating from an outer surface of said shaft to said hollow core;

a supporting base, said base connected to said lower end;

a gas input connection, said connection affixed to either of said shaft and said base and being in fluid communication with said hollow core;

at least one inflatable flag member, said flag member being affixed to said shaft, formed of flexible material and having at least one inflatable chamber, said chamber being in fluid communication with said at least one aperture and having at least one exhaust vent;

a compressed gas source, said gas source being in fluid communication with said gas input connection;

a compressed gas timing modulating device, said timing modulating device being in fluid communication with and disposed between said compressed gas source and said input connection;

said timing modulating device permitting compressed gas to flow intermittently into said gas input connection for a first predetermined period of time, after which said flow is terminated for a second predetermined period of time, and then resumed; and whereby, when compressed gas is distributed from said compressed gas source to said gas input connection, said inflatable chamber will become filled with compressed gas and cause said inflatable flag member to assume an erect posture with said compressed gas dissipating through said at least one exhaust vent.

2. The inflatable flag display, as described in claim 1, wherein at least one of said first and second predetermined periods of time may be varied by a user.

3. The inflatable flag display, as described in claim 1, wherein said shaft rotates about said supporting base.

4. The inflatable flag display, as described in claim 3, wherein said compressed gas causes said shaft to rotate about said supporting base.

5. An inflatable flag display, comprising:

a shaft, said shaft having a hollow core, a sealed upper end, an upper portion, a lower end and a lower portion;

at least one aperture, said aperture disposed in said upper portion and penetrating from an outer surface of said shaft to said hollow core;

a supporting base, said base connected to said lower end;

a gas input connection, said connection affixed to either of said shaft and said base and being in fluid communication with said hollow core;

at least one inflatable flag member, said flag member being affixed to said shaft, formed of flexible material and having at least one inflatable chamber, said chamber being in fluid communication with said at least one aperture and having at least one exhaust vent;

a compressed gas source, said gas source being in fluid communication with said gas input connection;

a compressed gas pressure modulating device, said pressure modulating device being in fluid communication with and disposed between said compressed gas source and said gas input connection;

said pressure modulating device permitting compressed gas to flow intermittently into said gas input connection until a first predetermined pressure in said flag member has been reached, after which said flow is terminated until a second, lower predetermined pressure has been reached, said flow is then resumed; and whereby, when compressed gas is distributed from said compressed gas source to said gas input connection, said inflatable chamber will become filled with compressed gas and cause said inflatable flag member to assume an erect posture with said compressed gas dissipating through said at least one exhaust vent.

6. The inflatable flag display, as described in claim 5, wherein at least one of said first and second predetermined pressures may be varied by a user.

7. The inflatable flag display, as described in claim 4, wherein said shaft rotates about said supporting base.

8. The inflatable flag display, as described in claim 7, wherein said compressed gas causes said shaft to rotate about said supporting base.

9. An inflatable flag display, comprising:

an inflatable column, said column having a hollow core, a sealed upper end, an upper portion, a lower end and a lower portion;

at least one aperture, said aperture disposed in said upper portion and penetrating from an outer surface of said column to said hollow core;

a gas input connection, said connection affixed to said column and being in fluid communication with said hollow core;

at least one inflatable flag member, said flag member being affixed to said inflatable column, formed of flexible material and having at least one inflatable chamber, said chamber being in fluid communication with said at least one aperture and having at least one exhaust vent;

a compressed gas source, said gas source being in fluid communication with said gas input connection;

a compressed gas timing modulating device, said timing modulating device being in fluid communication with and disposed between said compressed gas source and said gas input connection;

said timing modulating device permitting compressed gas to flow intermittently into said gas input connection for a first predetermined period of time, after which said flow is terminated for a second predetermined period of time, and then resumed; and whereby, when compressed gas is distributed from said compressed gas source to said gas input connection, said inflatable chamber will become filled with compressed gas and cause said inflatable flag member to assume an erect posture with said compressed gas dissipating through said at least one exhaust vent.

10. The inflatable flag display, as described in claim 9, wherein at least one of said first and second predetermined periods of time may be varied by a user.

11. An inflatable flag display, comprising:

an inflatable column, said column having a hollow core, a sealed upper end, an upper portion, a lower end and a lower portion;

at least one aperture, said aperture disposed in said upper portion and penetrating from an outer surface of said column to said hollow core;

a gas input connection, said connection affixed to said column and being in fluid communication with said hollow core;

at least one inflatable flag member, said flag member being affixed to said inflatable column, formed of flexible material and having at least one inflatable chamber, said chamber being in fluid communication with said at least one aperture and having at least one exhaust vent;

a compressed gas source, said gas source being in fluid communication with said gas input connection;

a compressed gas pressure modulating device, said pressure modulating device being in fluid communication with and disposed between said compressed gas source and said gas input connection;

said pressure modulating device permitting compressed gas to flow intermittently into said gas input connection until a first predetermined pressure in said flag member has been reached, after which said flow is terminated until a second, lower predetermined pressure has been reached, said flow is then resumed; and whereby, when compressed gas is distributed from said compressed gas source to said gas input connection, said inflatable chamber will become filled with compressed gas and cause said inflatable flag member to assume an erect posture with said compressed gas dissipating through said at least one exhaust vent.

12. The inflatable flag display, as described in claim 11, wherein at least one of said first and second predetermined pressures may be varied by a user.

* * * * *